US010193257B1

(12) United States Patent
Hirakawa et al.

(10) Patent No.: US 10,193,257 B1
(45) Date of Patent: Jan. 29, 2019

(54) CONNECTION TERMINAL

(71) Applicant: Yazaki Corporation, Tokyo (JP)

(72) Inventors: Takayoshi Hirakawa, Shizuoka (JP); Yasuhiro Tanaka, Shizuoka (JP); Kengo Machida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/946,589

(22) Filed: Apr. 5, 2018

(30) Foreign Application Priority Data

Mar. 1, 2018 (JP) ..... 2018-036066

(51) Int. Cl.
*H01R 13/187* (2006.01)
*H01R 13/11* (2006.01)
*H01R 4/18* (2006.01)

(52) U.S. Cl.
CPC ..... *H01R 13/111* (2013.01); *H01R 4/184* (2013.01)

(58) Field of Classification Search
CPC ..... H01R 13/052; H01R 13/187
USPC ..... 439/843, 851, 852, 854–857
See application file for complete search history.

(56) References Cited

U.S. PATENT DOCUMENTS 4,550,972 A * 11/1985 Romak ..... H01R 13/111 439/839
5,474,479 A * 12/1995 Bennett ..... H01R 13/187 439/843
6,042,432 A * 3/2000 Hashizawa ..... H01R 13/187 439/843
7,462,078 B2 * 12/2008 Mao ..... H01R 13/187 439/843
2006/0252294 A1 11/2006 Cvasa et al.
2016/0254610 A1 9/2016 Hirakawa et al.

FOREIGN PATENT DOCUMENTS

| | | | |
|---|---|---|---|
| CN | 206595440 | U | 10/2017 |
| DE | 198 36 196 | A1 | 2/1999 |
| GB | 2 270 425 | A | 3/1994 |
| JP | 61-126576 | U | 8/1986 |
| JP | 5579213 | B2 | 8/2014 |
| JP | 2015-76199 | A | 4/2015 |

OTHER PUBLICATIONS

The extended European search report for the related European Patent Application No. 18166261.0 dated Oct. 16, 2018.

* cited by examiner

*Primary Examiner* — Hien Vu
(74) *Attorney, Agent, or Firm* — Kenealy Vaidya LLP

(57) ABSTRACT

A connection terminal includes a terminal main body having a female connector provided with an internal space into which a male connector is inserted and a contact member accommodated into the internal space. The contact member has at least one first locked part and at least one second locked part. The female connector has a first locking part that is arranged on a side in an insertion direction of the male connector and locks the movement of the first locked part in the insertion direction, and a second locking part that is arranged on a side opposite to the side in the insertion direction relative to the second locked part of the contact member after the completion of being accommodated and locks the movement of the second locked part in a removal direction in order to maintain the accommodated state of the contact member.

10 Claims, 11 Drawing Sheets

CONNECTION TERMINAL

CROSS-REFERENCE TO RELATED APPLICATION(S)

The present application claims priority to and incorporates by reference the entire contents of Japanese Patent Application No. 2018-036066 filed in Japan on Mar. 1, 2018.

BACKGROUND OF THE INVENTION

1. Field of the Invention

The present invention relates to a connection terminal.

2. Description of the Related Art

Conventionally, there is known a connection terminal including a terminal main body having a female connector provided with a columnar internal space into which a male connector of a counter male terminal is inserted and a contact member that is accommodated into the internal space and is electrically connected to the female connector and the male connector. This kind of connection terminal is disclosed in Japanese Patent No. 5579213 and Japanese Patent Application Laid-open No. 2015-76199, for example.

The conventional connection terminal includes a locking structure that locks the contact member to the internal space of the female connector, because the terminal main body and the contact member are prepared as separate components. In the connection terminal of Japanese Patent No. 5579213, for example, a cylindrical contact member is arranged on a base material of the female connector before the female connector is formed, with the arrangement state, the female connector is formed in a concentric cylindrical shape so as to wrap the contact member, and walls that narrow both openings in an axial line direction of this female connector are also formed. In the connection terminal, since the contact member is locked by the walls, this contact member can be locked to the internal space of the female connector. However, a jig or the like is required for continuing to arrange the contact member at a predetermined position on the base material with a predetermined state, and hence there is room for improvement in terms of productivity and cost. In addition, some conventional connection terminals have a production mode in which the terminal main body and the contact member are formed in a tubular form in advance, and the contact member is inserted from the opening of the female connector, thereby accommodating the contact member into the internal space. The connection terminal of this case includes an annular lid member that blocks a circumferential edge of the opening, for example, and this lid member is mounted on the opening, thereby locking the contact member by this lid member to be locked to the internal space of the female connector. Consequently, this connection terminal has a large number of components and production man-hours and has room for improvement in terms of productivity and cost. Thus, the conventional connection terminals have room for improvement in the locking structure for the contact member in terms of productivity and cost.

SUMMARY OF THE INVENTION

An object of the present invention is therefore to provide a connection terminal including a simple locking structure for a contact member.

In order to achieve the above mentioned object, a connection terminal according to one aspect of the present invention includes a terminal main body that is made of a conductive material and has a female connector provided with a columnar internal space into which a male connector of a counter male terminal is inserted and a wire connector to which a conducting part of a wire is electrically connected, and a contact member that is made of a conductive material, is accommodated into the internal space along a part in a circumferential direction of an inner circumferential face of the female connector and is electrically connected to the female connector, and is electrically connected to the male connector inserted into the internal space from an opening serving as a male terminal insertion port of the female connector, wherein the contact member is formed along the part in the circumferential direction of the inner circumferential face of the female connector and includes at least one first locked part and at least one second locked part, and the female connector includes a first locking part that is arranged on a side of the female connector in an insertion direction of the male connector into the internal space relative to the first locked part of the contact member after completion of being accommodated into the internal space and that locks movement of the first locked part to the side in the insertion direction in order to maintain an accommodated state of the contact member in the internal space, and a second locking part that is arranged on a side of the female connector in a removal direction of the male connector opposite to the insertion direction relative to the second locked part of the contact member after the completion of being accommodated and that locks movement of the second locked part to the side in the removal direction in order to maintain the accommodated state of the contact member in the internal space.

According to another aspect of the present invention, in the connection terminal, the first locked part may protrude toward the inner circumferential face of the female connector from the contact member after the completion of being accommodated, and the female connector may have a notch into which the first locked part is inserted upon the completion of accommodation of the contact member into the internal space at an end in a side of the opening, and a wall of the notch in the insertion direction may be used as the first locking part.

According to still another aspect of the present invention, in the connection terminal, the second locked part may protrude toward the inner circumferential face of the female connector from the contact member after the completion of being accommodated, and the female connector may have an accommodation space into which the second locked part is accommodated upon the completion of accommodation of the contact member into the internal space, and a wall of the accommodation space in the removal direction may be used as the second locking part.

According to still another aspect of the present invention, in the connection terminal, the contact member may have an accommodation space into which an object to be accommodated is accommodated, and a wall of the accommodation space in the insertion direction may be used as the second locked part, and the female connector may have a protruding part that protrudes toward the internal space and is accommodated into the accommodation space upon the completion of accommodation of the contact member into the internal space, and a wall of the protruding part in the insertion direction may be used as the second locking part.

According to still another aspect of the present invention, in the connection terminal, the contact member may include at least two first contacts arranged to be spaced apart from each other in an insertion/removal direction of the female connector and a plurality of second contacts serving as coupling parts that couple the two adjacent first contacts to each other, the first contacts may be formed along the part in the circumferential direction of the inner circumferential face of the female connector and may be electrically connected to the inner circumferential face on an opposite face side to the inner circumferential face, and the second contacts may be arranged in the internal space while being coupled to the first contacts, may be push-moved toward the inner circumferential face of the female connector by the male connecter inserted into the internal space and may be electrically connected to the male connector, and may be formed in an arcuate shape protruding inward in a radial direction of the internal space between the two adjacent first contacts so as to be bent outward in the radial direction when being pushed outward in the radial direction of the internal space by the male connector inserted into the internal space.

The above and other objects, features, advantages and technical and industrial significance of this invention will be better understood by reading the following detailed description of the presently preferred embodiment of the invention, when considered in connection with the accompanying drawings.

DETAILED DESCRIPTION OF THE PREFERRED EMBODIMENTS

The following describes an embodiment of a connection terminal according to the present invention in detail with reference to the accompanying drawings. Note that this embodiment does not limit this invention.

EMBODIMENT

The following describes an embodiment of the connection terminal according to the present invention with reference to FIG. 1 to FIG. 6.

Figure 1:
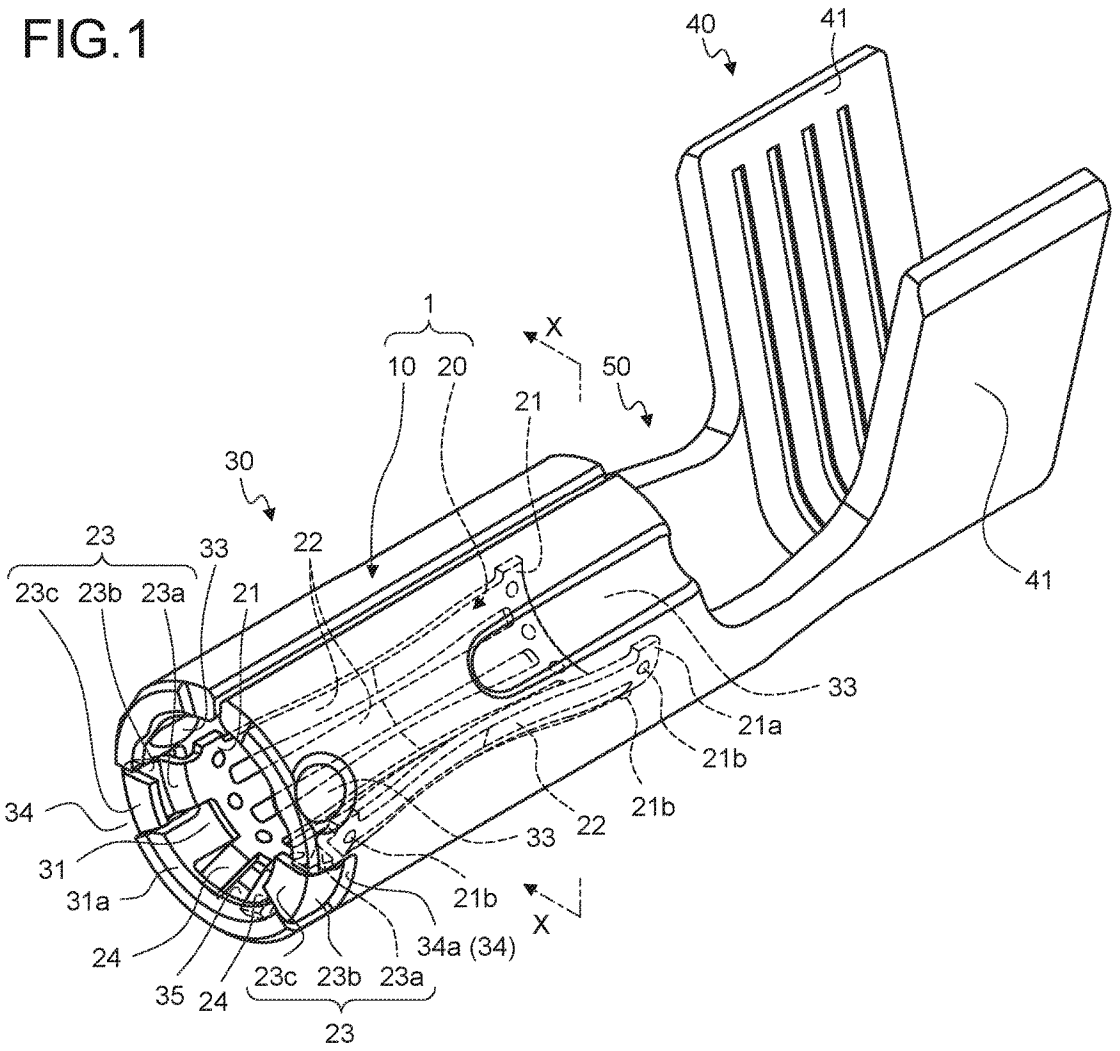
FIG. 1 is a perspective view of a connection terminal of an embodiment.
Figure 2:
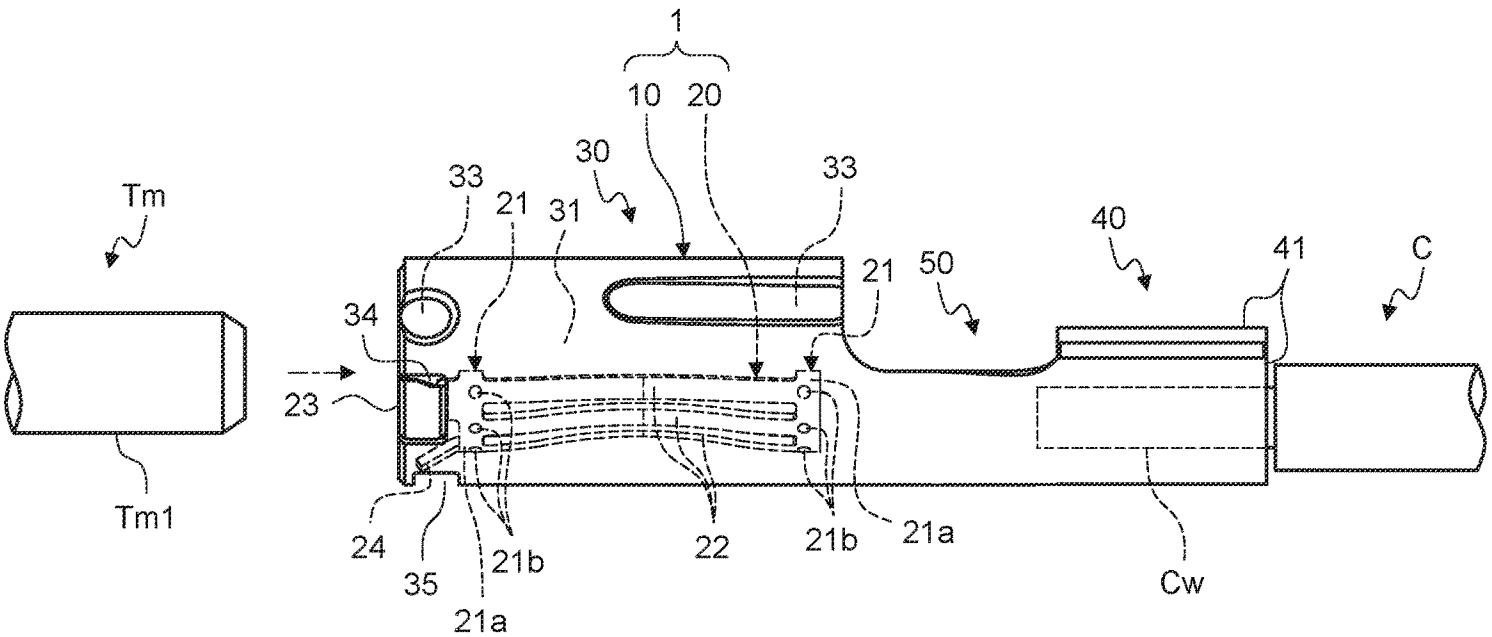
FIG. 2 is a side view of the connection terminal of the embodiment.

Reference numeral 1 in FIG. 1 to FIG. 4 indicates a connection terminal of the present embodiment. This connection terminal 1 is called a female terminal and establishes physical and electric connection with a counter male terminal Tm (FIG. 2). This connection terminal 1 includes a terminal main body 10 and a contact member 20 and is formed by assembling them.

The terminal main body 10 is made of a conductive material such as metal. This exemplary terminal main body 10 is formed by performing press working such as cutting and bending on a conductive metal plate as a base material. This terminal main body 10 has a female connector 30, a wire connector 40, and a coupler 50.

The female connector 30 is a part formed to be a female type in order for a male connector Tm1 of the male terminal Tm to be inserted thereinto and electrically connects the two to each other along with the insertion. The female connector 30, which is unconcerned about its appearance, is formed in a tubular shape having an internal space 31 with a shape in accordance with the male connector Tm1 formed in a columnar shape, corresponding to the columnar shape. The female connector 30 opens at least one end in an axial line direction of the tubular body. An opening 31*a* at the one end is used as an insertion port (a male terminal insertion port) to the internal space 31 for the male connector Tm1 and is used also as an insertion port (a contact member insertion port) to the internal space 31 for the contact member 20. In addition, this opening 31*a* is used also as a removal port when the male connector Tm1 is removed from the internal space 31. When the male connector Tm1 is formed as a plate-shaped bus bar or to be a prismatic shape, the female connector 30 is formed in a prismatic shape having the internal space 31 of a prismatic shape corresponding to the shape, and when the male connector Tm1 is formed in a cylindrical shape, the female connector 30 is formed in a cylindrical shape having the internal space 31 of a cylindrical shape corresponding to the shape, for example. In this example, the internal space 31 of the female connector 30 and the male connector Tm1 are formed in a cylindrical shape that enables mutual insertion/removal operations, and the insertion and the removal of the male connector Tm1 into and from the internal space 31 are executed along its axial line. In this example, a plate-shaped base material is bent to form the female connector 30 in a cylindrical shape, thereby forming the internal space 31 into a cylindrical shape thereinside.

The wire connector 40 is a part to which a conducting part Cw (FIG. 2) of a wire C is electrically connected. The connection may be performed by any of crimping such as swaging, welding, and soldering, for example. In this example, a base material is bent to form the wire connector 40 into a U shape. The wire connector 40 has two barrel pieces 41 opposed to each other, and both barrel pieces 41 are wound around a core wire of the wire C as the conducting part Cw to be crimped on the conducting part Cw and are thereby connected to this conducting part Cw physically and electrically.

The coupler 50 is a part interposed between the female connector 30 and the wire connector 40 and couples them to each other.

The contact member 20 is formed along an inner circumferential face 32 (FIG. 4) of the female connector 30 of this terminal main body 10 and is accommodated into the internal space 31 of the female connector 30 through the opening 31*a*. This contact member 20, in its accommodated state, is electrically connected to the female connector 30 and is electrically connected to the male connector Tm1 accommodated into the internal space 31 from the opening 31*a*. This contact member 20 is made of a conductive material such as metal. This exemplary contact member 20 is formed by performing press working such as cutting and bending on a conductive metal plate as a base material.

This contact member 20 appropriately changes its respective positions in the axial line direction (a direction along an insertion direction to the internal space 31) by making it narrower or the like and is inserted into the internal space 31 with the respective positions made smaller. However, when becoming cylindrical in the internal space of a female connector as in a conventional contact member, this contact member 20 involves a large amount of change in a curvature of the respective positions in the axial line direction during its insertion, and durability may degrade. Further, in such a contact member becoming cylindrical, the amount of change in the curvature of the respective positions in the axial line direction is large, and work for inserting the contact member into the internal space of the female connector may be difficult. Even in this case, along with the bending of the female connector into a cylindrical shape, the contact member is wrapped thereinside in place of the work for inserting it, the contact member is required to be arranged on the base material of the female connector while being made narrower in a cylindrical shape. Consequently, the conventional connection terminal has room for improvement in terms of durability and productivity.

Therefore, the contact member 20 forms its external shape along a part in a circumferential direction of the inner circumferential face 32 of the female connector 30. The contact member 20 is formed to have an external shape corresponding to the part in the circumferential direction of the inner circumferential face 32 regardless of the internal space 31 being cylindrical or prismatic. In this example, the internal space 31 is cylindrical, and the contact member 20 forms its external shape so as to cause the respective positions in the axial line direction to be arcuate. A size of the arc sets its central angle to the extent of not being an annular ring. Consequently, in this connection terminal 1, the contact member 20 can be inserted into the internal space 31 with the amount of change in curvature reduced compared with the conventional cylindrical contact member. Consequently, the contact member 20 can stop the change in curvature during its insertion within the range of an elastic range and can thus improve its durability. Further, this connection terminal 1 can also improve its productivity by this contact member 20.

Specifically, this contact member 20 has a first contact 21 electrically connected to the female connector 30 and a second contact 22 electrically connected to the male connector Tm1 accommodated into the internal space 31.

The first contact 21 is formed in a shape along the part in the circumferential direction of the inner circumferential face 32 of the female connector 30. This first contact 21 is electrically connected to the inner circumferential face 32 on an opposite face side of the inner circumferential face 32. This exemplary first contact 21 is formed in an arcuate shape in the circumferential direction of the inner circumferential face 32 of the female connector 30, and its arcuate outer circumferential face 21*a* (FIG. 5) side is opposed to the inner circumferential face 32. Consequently, this exemplary first contact 21 is electrically connected to the inner circumferential face 32 of the female connector 30 on the arcuate outer circumferential face 21*a* side. This exemplary outer circumferential face 21*a* is formed with a plurality of spherical contacts 21*b* swelled outward in a radial direction. The contacts 21*b* are arranged at substantially regular intervals in the circumferential direction of the outer circumferential face 21*a*. The first contact 21 is brought into contact with the inner circumferential face 32 of the female connector 30 via the contacts 21*b*.

The second contact 22 is arranged in the internal space 31 while being coupled to the first contact 21. This second contact 22 is pushed outward in a radial direction of the internal space 31 (toward the inner circumferential face 32) by the male connector Tm1 inserted into the internal space 31. This second contact 22 comes into contact with the male connector Tm1 at its pushed part (a pushed part) and is electrically connected to the male connector Tm1 with the pushed part as a contact.

The contact member 20 includes each of the first contact 21 and second contact 22 by at least one. The contact member 20 has at least two first contacts 21 arranged to be spaced apart from each other in the axial line direction (an insertion/removal direction) of the female connector 30 and has a plurality of second contacts 22 as coupling parts that couple two adjacent first contacts 21 to each other, for example. The first contacts 21 are arranged so as to be concentric with the internal space 31 and are offset from each other in the axial line direction. The second contacts 22 are formed so as to be bent outward in the radial direction when pushed outward in the radial direction of the internal space 31 by the male connector Tm1 inserted into the internal space 31. In this example, the second contacts 22 are formed in an arcuate shape protruding inward in the radial direction between the two adjacent first contacts 21, and an inward apex in the radial direction of the protruding shape is the pushed part as the contact.

The contact member 20 is arranged so as to face about half the area in the circumferential direction of the inner circumferential face 32 of the female connector 30. In this example, the contact member 20 is arranged at a part connected to a coupling part coupling the barrel pieces 41 to each other (the bottom face side of the internal space 31 in the drawing of FIG. 3, for example). However, this arrangement place of the contact member 20 in the circumferential direction of the internal space 31 is not necessarily limited to this exemplary mode and may be at any position in the circumferential direction.

Figure 3:
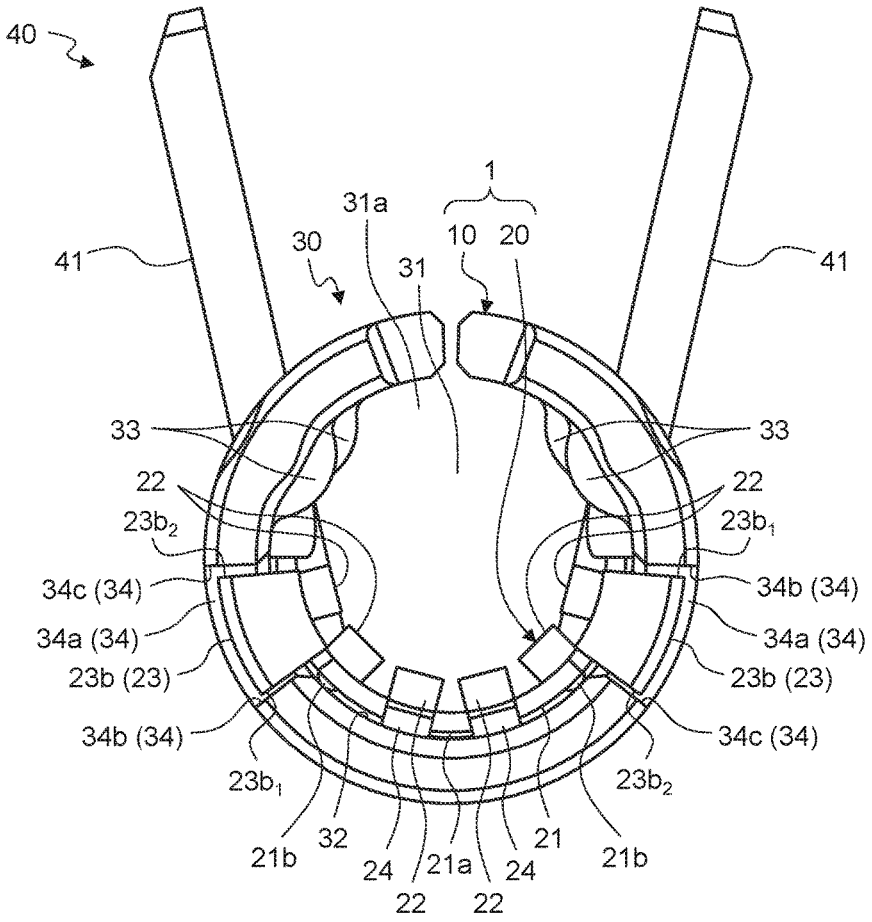
FIG. 3 is an elevational view of the connection terminal of the embodiment.

The female connector 30 of the present embodiment includes a plurality of contacts 33 provided at places where the contact member 20 is not arranged on the inner circumferential face 32 (FIG. 3). The contacts 33 are formed as swelled parts swelled inward in the radial direction in the internal space 31. The male connector Tm1 accommodated into the internal space 31 is held between the contact member 20 and each of the contacts 33, and a holding force is ensured in the internal space 31 by the contact member 20 and the contact 33. Consequently, this male connector Tm1 establishes the electric connection with the female connector 30 indirectly via the contact member 20 and directly via the contacts 33.

This exemplary female connector 30 includes four contacts 33. Specifically, the female connector 30 includes two contacts 33 spaced apart from each other in the circumferential direction at the end on the opening 31*a* side and includes two contacts 33 spaced apart from each other in the circumferential direction at the end on the coupler 50 side (FIG. 1 to FIG. 4). The contacts 33 on the opening 31*a* side are spherical swelled parts swelled inward in the radial direction from the inner circumferential face 32. The contacts 33 on the coupler 50 side are arcuate swelled parts swelled inward in the radial direction from the inner circumferential face 32 and are extended in the axial line direction.

A frictional force and the like acts between the contact member 20 and the male connector Tm1, when the male connector Tm1 is inserted into and removed from the internal space 31, and a force in the insertion/removal direction corresponding to the frictional force and the like is applied to the contact member 20 from the male connector Tm1. Consequently, as long as the connection terminal 1 has the configuration of the present embodiment described above alone, the contact member 20 may, when the male connector Tm1 is inserted and removed, relatively move relative to the female connector 30 (the internal space 31) in the insertion/removal direction. Thus, the contact member 20 may relatively move in the axial line direction (the same direction as the insertion/removal direction) and/or the circumferential direction relative to the female connector 30 by an external input such as vibrations during the production of the connection terminal 1, during the transportation of the connection terminal 1 after the production, and the like even when such a force from the male connector Tm1 is not applied.

The connection terminal 1 of the present embodiment therefore provides a locking structure that can lock the contact member 20 relative to the female connector 30 while being in the accommodated state in the internal space 31 in order to inhibit the relative positional deviation of the contact member 20 that has been accommodated into the internal space 31 relative to the female connector 30.

This connection terminal 1 includes a locking structure that inhibits a relative positional deviation of the contact member 20 in a first direction along the axial line direction relative to the female connector 30. The first direction corresponds to an insertion direction when the contact member 20 is accommodated into the internal space 31 from the opening 31*a* and is also an insertion direction when the male connector Tm1 is accommodated into the internal space 31 from the opening 31*a*. For this reason, this locking structure is referred to as an "insertion direction locking structure." The insertion direction is referred to as a "male terminal insertion direction." In addition, this connection terminal 1 includes a locking structure that inhibits the relative positional deviation of the contact member 20 in a second direction along the axial line direction relative to the female connector 30. The second direction is opposite to the male terminal insertion direction and is a removal direction when the male connector Tm1 within the internal space 31 is removed from the opening 31*a*. For this reason, this locking structure is referred to as a "removal direction locking structure." The removal direction is referred to as a "male terminal removal direction." The insertion/removal direction of the male connector Tm1 is referred to as a "male terminal insertion/removal direction."

Figure 4:
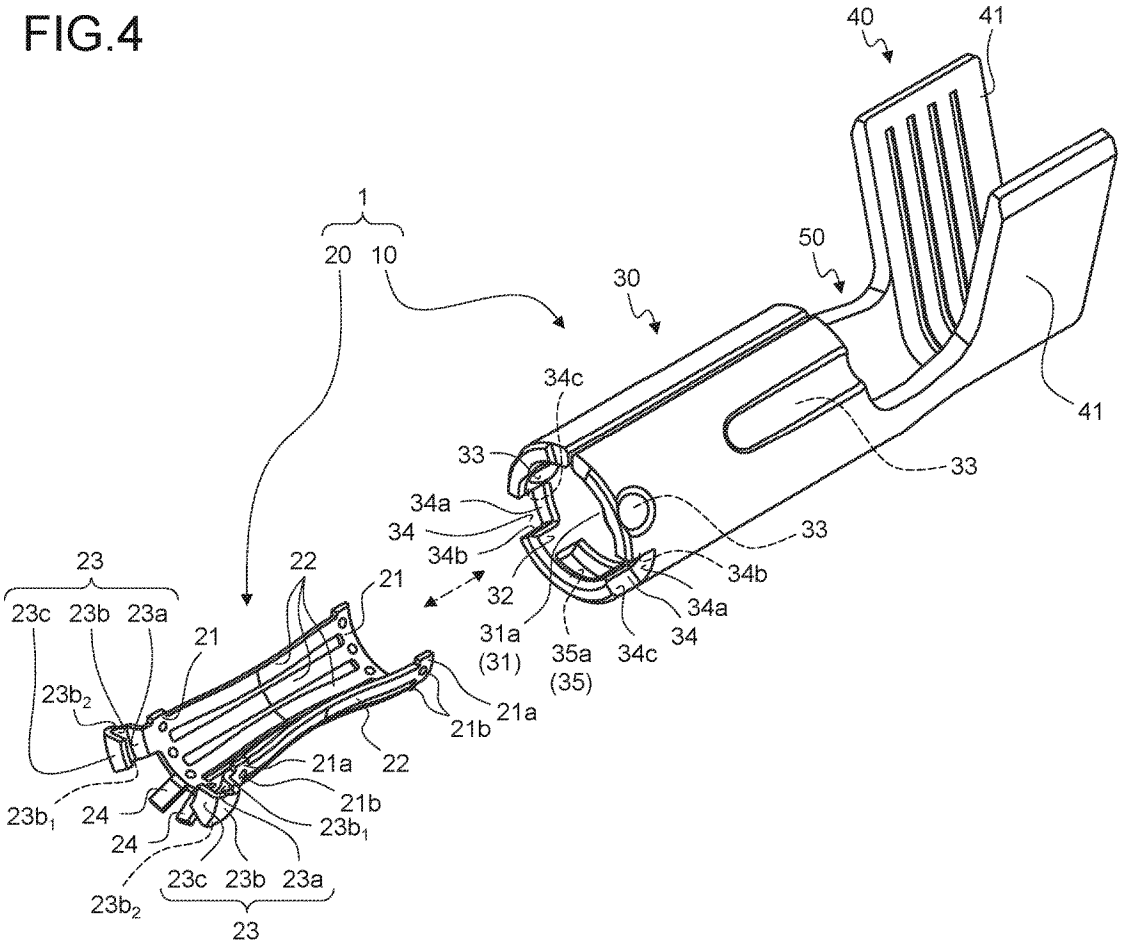
FIG. 4 is an exploded perspective view of the connection terminal of the embodiment.
Figure 5:
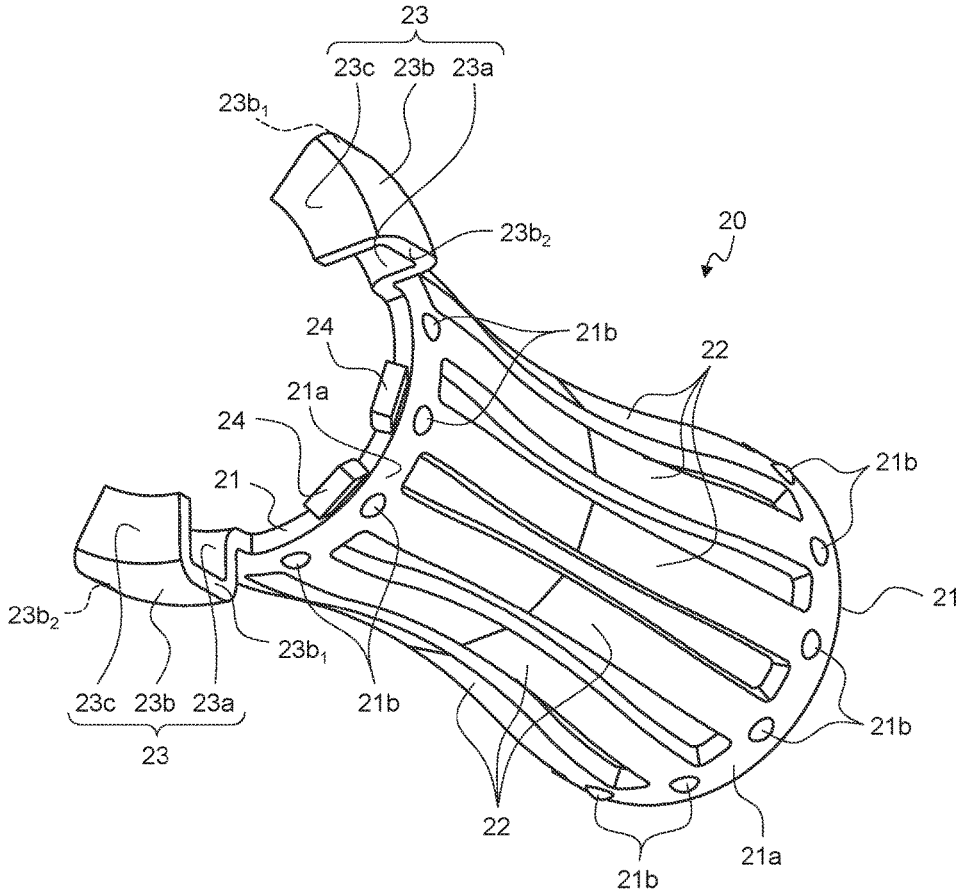
FIG. 5 is a perspective view of a contact member of the embodiment.

The following first describes the insertion direction locking structure. This insertion direction locking structure locks the contact member 20 to a predetermined position in the axial line direction (the male terminal insertion/removal direction) in the internal space 31 when the contact member 20 is accommodated into the internal space 31 and when the male connector Tm1 is accommodated into the internal space 31. The predetermined position is referred to as an accommodation completion position of the contact member 20 in the internal space 31. This insertion direction locking structure includes a first locked part 23*a* provided on the contact member 20 and a first locking part 34*a* provided on the female connector 30 to lock the movement of the first locked part 23*a* in the male terminal insertion direction (FIG. 1 and FIG. 4). The insertion direction locking structure includes at least one each of the first locked part 23*a* and the first locking part 34*a*. This insertion direction locking structure includes a plurality of combinations of one first locked part 23*a* and one first locking part 34*a*, for example.

The first locked part 23*a* is formed so as to protrude toward the inner circumferential face 32 of the female connector 30 from this contact member 20 in the contact member 20 after the completion of being accommodated. This exemplary first locked part 23*a* is provided so as to be arranged on the opening 31*a* side in the internal space 31 in the contact member 20 after the completion of being accommodated. Thus, in this example, the first locked part 23*a* protrudes toward the inner circumferential face 32 from the first contact 21 on the opening 31*a* side.

Specifically, this exemplary first locked part 23*a* is provided as a part of a locking body 23 protruding toward the inner circumferential face 32 from the first contact 21 (FIG. 1 and FIG. 4 to FIG. 6). The locking body 23 is formed in a shape in which a plurality of piece shapes are connected to each other, and includes a first piece 23*a* protruding outward in the radial direction from the end on the opening 31*a* side of the first contact 21, a second piece 23*b* protruding in the male terminal removal direction from an end on the protruding side of this first piece 23*a*, and a third piece 23*c* protruding inward in the radial direction from an end on the protruding side of this second piece 23*b*. In this example, the first piece 23*a* is used as the first locked part 23*a*.

The first locking part 34*a* locks the movement of the first locked part 23*a* in the male terminal insertion direction in order to maintain an accommodated state of the contact member 20 in the internal space 31. For this purpose, this first locking part 34*a* is provided on a side in the male terminal insertion direction beyond the first locked part 23*a* of the contact member 20 after the completion of being accommodated into the female connector 30 and is opposed to an end or a wall face of this first locked part 23*a* in the male terminal insertion direction.

The first locking part 34*a* and the first locked part 23*a* may be in contact with each other or be provided with a gap therebetween when the contact member 20 has been completely accommodated into the internal space 31. The gap is an amount of relative movement until the first locked part 23*a* at the accommodation completion position is locked by the first locking part 34*a* and is set so as to cause the amount of relative movement to be within an allowed value. The allowed value may be determined from the amount of relative movement of the first locked part 23*a* within a range in which the electric connected state between the contact member 20 and the female connector 30 and the male connector Tm1 is not hindered and is set at the maximum value of the amount of relative movement, for example.

This exemplary female connector 30 has notches 34 in which the insertion of the first locked parts 23*a* completes concurrently with the completion of accommodation of the contact member 20 into the internal space 31 at the end on the opening 31*a* side (FIG. 1 and FIG. 4 to FIG. 6). Each of the notches 34 is formed in a shape and at a position into which the third piece 23*c* of the corresponding locking body 23 is inserted by the completion of accommodation of the contact member 20 into the internal space 31. In this example, walls of these notches 34 in the male terminal insertion direction in the male terminal insertion/removal direction are used as the first locking parts 34*a*.

In this exemplary insertion direction locking structure, as described above, one first locked part 23*a* and one first locking part 34*a* form a combination, and two combinations thereof are provided to be spaced apart from each other in the circumferential direction. In the first contact 21 on the opening 31*a* side, one locking body 23 is arranged at each end in the circumferential direction thereof, for example. At the end on the opening 31*a* side of the female connector 30, one notch 34 corresponding to the position of each of the locking bodies 23 is formed, with the notches 34 spaced apart from each other in the circumferential direction.

In this insertion direction locking structure, when the contact member 20 is accommodated into the internal space 31 from the opening 31*a*, the contact member 20 is assembled to the female connector 30 so as to cause the respective locking bodies 23 to be inserted into the respective notches 34, whereby even if this contact member 20 attempts to advance in the male terminal insertion direction further from the accommodation completion position within the internal space 31, the first locked part 23*a* is locked by the first locking part 34*a*. Consequently, this insertion direction locking structure can stop the advancement of the contact member 20 in the male terminal insertion direction beyond the accommodation completion position. Consequently, when the contact member 20 is assembled to the female connector 30, this insertion direction locking structure can inhibit the relative positional deviation of the contact member 20 in the axial line direction (the male terminal insertion/removal direction) relative to the female connector 30 and place this contact member 20 at the accommodation completion position within the internal space 31.

Further, in this insertion direction locking structure, when the male connector Tm1 is accommodated into the internal space 31 from the opening 31*a*, even if a force such as a frictional force in the male terminal insertion direction acts on the contact member 20 from the male connector Tm1, the first locked part 23*a* is locked by the first locking part 34*a*. For this reason, this insertion direction locking structure after the lock does not cause the relative movement of the contact member 20 in the male terminal insertion direction relative to the female connector 30. Consequently, when the male connector Tm1 is fit into the female connector 30, this insertion direction locking structure can inhibit the relative positional deviation of the contact member 20 in the axial line direction (the male terminal insertion/removal direction) relative to the female connector 30.

Figure 6:
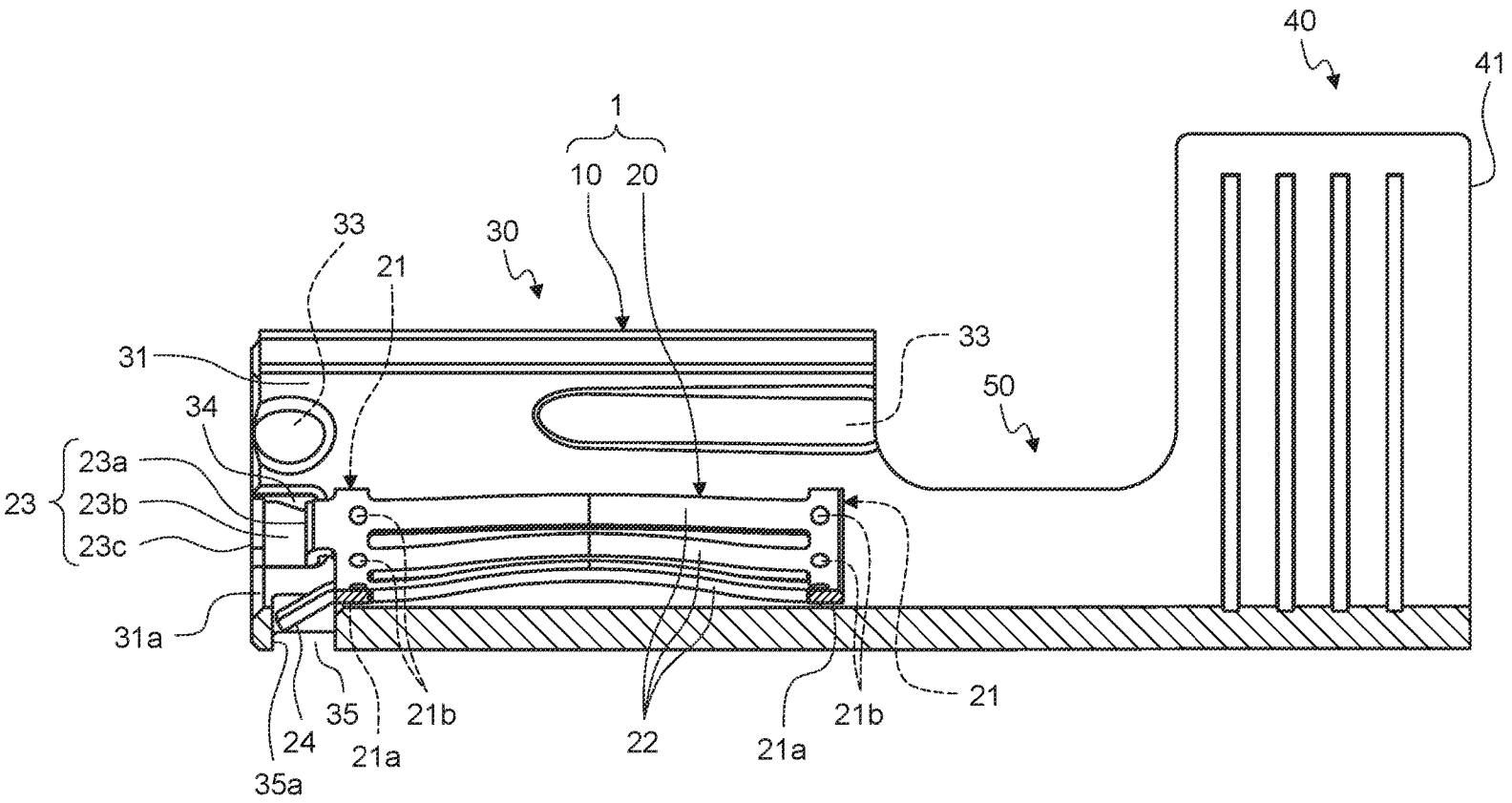
FIG. 6 is an X-X line sectional view of FIG. 1.

The following describes the removal direction locking structure. This removal direction locking structure is for locking the contact member 20 to a predetermined position in the axial line direction (the male terminal insertion/removal direction) within the internal space 31 when the male connector Tm1 within the internal space 31 is removed from the opening 31*a*. The predetermined position refers to the accommodation completion position of the contact member 20 in the internal space 31. This removal direction locking structure includes a second locked part 24 provided on the contact member 20 and a second locking part 35*a* provided on the female connector 30 to lock the movement of the second locked part 24 in the male terminal removal direction (FIG. 4 and FIG. 6). The removal direction locking structure includes at least one each of the second locked part 24 and the second locking part 35*a*.

The second locked part 24 is formed so as to protrude toward the inner circumferential face 32 of the female connector 30 from this contact member 20 in the contact member 20 after the completion of being accommodated. This exemplary second locked part 24 is provided so as to be arranged on the opening 31*a* side in the internal space 31 in the contact member 20 after the completion of being accommodated. Thus, in this example, the second locked part 24 protrudes toward the inner circumferential face 32 from the first contact 21 on the opening 31*a* side.

Specifically, this exemplary second locked part 24 protrudes obliquely toward the inner circumferential face 32 and protrudes in the male terminal removal direction from the end on the opening 31*a* side of the first contact 21 (in the male terminal removal direction) (FIG. 4 and FIG. 6). This second locked part 24 is formed in a substantially rectangular piece shape. In this example, two second locked parts 24 arranged to be spaced apart from each other in the circumferential direction are provided between the two locking bodies 23.

The second locking part 35*a* locks the movement of the second locked part 24 in the male terminal removal direction in order to maintain the accommodated state of the contact member 20 in the internal space 31. For this purpose, in the female connector 30, this second locking part 35*a* is provided on the side thereof in the male terminal removal direction beyond the second locked part 24 of the contact member 20 after the completion of being accommodated and is opposed to an end or a wall face of this second locked part 24 in the male terminal removal direction.

The second locking part 35*a* and the second locked part 24 may be in contact with each other or be provided with a gap therebetween when the contact member 20 has been completely accommodated into the internal space 31. The gap is an amount of relative movement until the second locked part 24 at the accommodation completion position is locked by the second locking part 35*a* and is set so as to cause the amount of relative movement to be within an allowed value. The allowed value may be determined from the amount of relative movement within a range in which the electric connected state between the contact member 20 and the female connector 30 and the male connector Tm1 is not hindered and is set at the maximum value of the amount of relative movement, for example.

The female connector 30 provides an accommodation space 35 such as a groove or a through hole in which the second locked part 24 is accommodated concurrently with the completion of accommodation of the contact member 20 into the internal space 31, for example. In this removal direction locking structure, a wall of the accommodation space 35 in the male terminal removal direction is used as the second locking part 35*a*. As this exemplary accommodation space 35, a rectangular through hole is formed at the end on the opening 31*a* side of the female connector 30 (in the male terminal removal direction), and a wall of this through hole in the male terminal removal direction is used as the second locking part 35*a* (FIG. 4 and FIG. 6). In this example, one accommodation space 35 is arranged between the two notches 34, and the two second locked parts 24 are inserted into this accommodation space 35.

In this removal direction locking structure, when the male connector Tm1 within the internal space 31 is removed from the opening 31*a*, even if a force such as a frictional force in the male terminal removal direction acts on the contact member 20 from this male connector Tm1, the second locked part 24 is locked by the second locking part 35*a*. For this reason, this removal direction locking structure after the lock does not cause the relative movement of the contact member 20 in the male terminal removal direction relative to the female connector 30. Consequently, when the male connector Tm1 is removed from the female connector 30, this removal direction locking structure can inhibit the relative positional deviation of the contact member 20 in the axial line direction (the male terminal insertion/removal direction) relative to the female connector 30.

The connection terminal 1 of the present embodiment further includes a locking structure that inhibits the relative positional deviation of the contact member 20 in the circumferential direction relative to the female connector 30 (hereinafter referred to as a "circumferential locking structure"). The circumferential locking structure includes a first circumferential locked part 23$b_1$ provided on the contact member 20, a second circumferential locked part 23$b_2$ provided on the contact member 20, a first circumferential locking part 34*b* provided on the female connector 30 to lock the movement of the first circumferential locked part 23$b_1$ in one circumferential direction, and a second circumferential locking part 34*c* provided on the female connector 30 to lock the movement of the second circumferential locked part 23$b_2$ in the other circumferential direction (FIG. 3 and FIG. 4). The circumferential locking structure includes at least one each of the first circumferential locked part 23$b_1$, the second circumferential locked part 23$b_2$, the first circumferential locking part 34*b*, and the second circumferential locking part 34*c*. This circumferential locking structure provides a plurality of combinations of one first circumferential locked part 23$b_1$ and one first circumferential locking part 34*b* and provides a plurality of combinations of one second circumferential locked part 23$b_2$ and one second circumferential locking part 34*c*, for example.

This circumferential locking structure is configured using the locking body 23 and the notch 34, for example. In the locking body 23, ends 23$b_1$ and 23$b_2$ in the circumferential direction of the second piece 23*b* are used as the first and the second circumferential locked parts 23$b_1$ and 23$b_2$, respectively. In the notch 34, ends 34*b* and 34*c* in the circumferential direction thereof are used as the first and second circumferential locking parts 34*b* and 34*c*, respectively.

The first circumferential locked part 23$b_1$ and the first circumferential locking part 34*b* are opposed to each other in the circumferential direction and may be in contact with each other or be provided with a gap therebetween when the contact member 20 has been completely accommodated into the internal space 31. Similarly, the second circumferential locked part 23$b_2$ and the second circumferential locking part 34*c* are opposed to each other in the circumferential direction and may be in contact with each other or be provided with a gap therebetween when the contact member 20 has been completely accommodated into the internal space 31. In this example, the respective gaps are provided so as not to hinder insertion workability for the contact member 20 into the internal space 31. In this example, the sum of the gaps is set to be within an allowed value. The allowed value is set so as not to hinder the electric connected state between the contact member 20 and the female connector 30 and the male connector Tm1.

When the male connector Tm1 is accommodated into the internal space 31 from the opening 31*a* and/or when the male connector Tm1 within the internal space 31 is removed from the opening 31*a*, relative rotation in the circumferential direction may occur between the female connector 30 and the male connector Tm1. However, in this circumferential locking structure, even if a circumferential force such as a frictional force acts on the contact member 20 from the male connector Tm1 by the relative rotation, the first circumferential locked part 23$b_1$ and the first circumferential locking part 34*b* or the second circumferential locked part 23$b_2$ and the second circumferential locking part 34*c* corresponding to the orientation of the force become a locked state. For this reason, this circumferential locking structure after the lock does not cause the relative movement of the contact member 20 in the circumferential direction relative to the female connector 30. Consequently, when the male connector Tm1 is fit into the female connector 30 or when the male connector Tm1 is removed from the female connector 30, this circumferential locking structure can inhibit the relative positional deviation of the contact member 20 in the circumferential direction relative to the female connector 30.

As described above, the connection terminal 1 of the present embodiment includes the insertion direction locking structure and the removal direction locking structure and can thereby inhibit the positional deviation of the contact member 20 within the internal space 31 in the axial line direction (the male terminal insertion/removal direction) relative to the female connector 30. Further, this connection terminal 1 includes the circumferential locking structure and can thereby inhibit the positional deviation of the contact member 20 within the internal space 31 in the circumferential direction relative to the female connector 30. Consequently, the connection terminal 1 of the present embodiment can lock the contact member 20 to the accommodation completion position within the internal space 31 when the contact member 20 is assembled to the female connector 30, when the male connector Tm1 is inserted and removed into and from the female connector 30, and even if external input such as vibrations during the production of the connection terminal 1, during the transportation of the connection terminal 1 after the production, and the like is applied.

Consequently, when the contact member 20 has been assembled to the female connector 30, this connection terminal 1 eliminates work for reassembling and the like and can improve its own productivity. Further, during working for being assembled to a device to be installed, this connection terminal 1 eliminates work for repositioning the contact member 20 within the internal space 31 and the like, and the productivity of the device can also be improved. Still further, when the counter male terminal Tm is fit thereinto, this connection terminal 1 eliminates work for repositioning the contact member 20 within the internal space 31 and the like, and connection workability for the male terminal Tm can be improved. Still further, this connection terminal 1 can inhibit the contact member 20 from dropping from the female connector 30 even without covering the female connector 30 with a lid member or the like.

Thus, the connection terminal 1 of the present embodiment can embody these effects by the simple configuration including the first and second locked parts 23*a* and 24 and the first and second locking parts 34*a* and 35*a* provided in the minimum required components, or the contact member 20, the terminal main body 10, and the female connector 30, without newly providing any exclusive components. In other words, this connection terminal 1 can achieve these effects while reducing cost.

Modification

The symbol 2 in FIG. 7 to FIG. 10 indicates a connection terminal of the present modification. In the connection terminal 2 of the present modification, components having functions equivalent to those of the connection terminal 1 of the embodiment will be illustrated with the same symbols as those of the connection terminal 1 for the convenience of description, and descriptions thereof will be omitted as appropriate.

The connection terminal 2 of the present modification is obtained by altering the connection terminal 1 of the embodiment as follows.

First, the connection terminal 2 of the present modification arranges the contact member 20 on a side opposite to the connection terminal 1 of the embodiment in the circumferential direction (a position deviated by substantially 180 degrees) in the internal space 31 of the female connector 30. Consequently, the connection terminal 2 of the present modification also arranges the four contacts 33 on a side opposite to the connection terminal 1 of the embodiment in the circumferential direction (positions deviated by substantially 180 degrees) in the internal space 31. However, this circumferential arrangement of the contact member 20 and the contacts 33 in the internal space 31 is not necessarily limited to the mode of the present modification and may be similar to that of the embodiment, for example.

Next, the connection terminal 2 of the present modification has the insertion direction locking structure and the removal direction locking structure with the following configurations.

Figure 7:
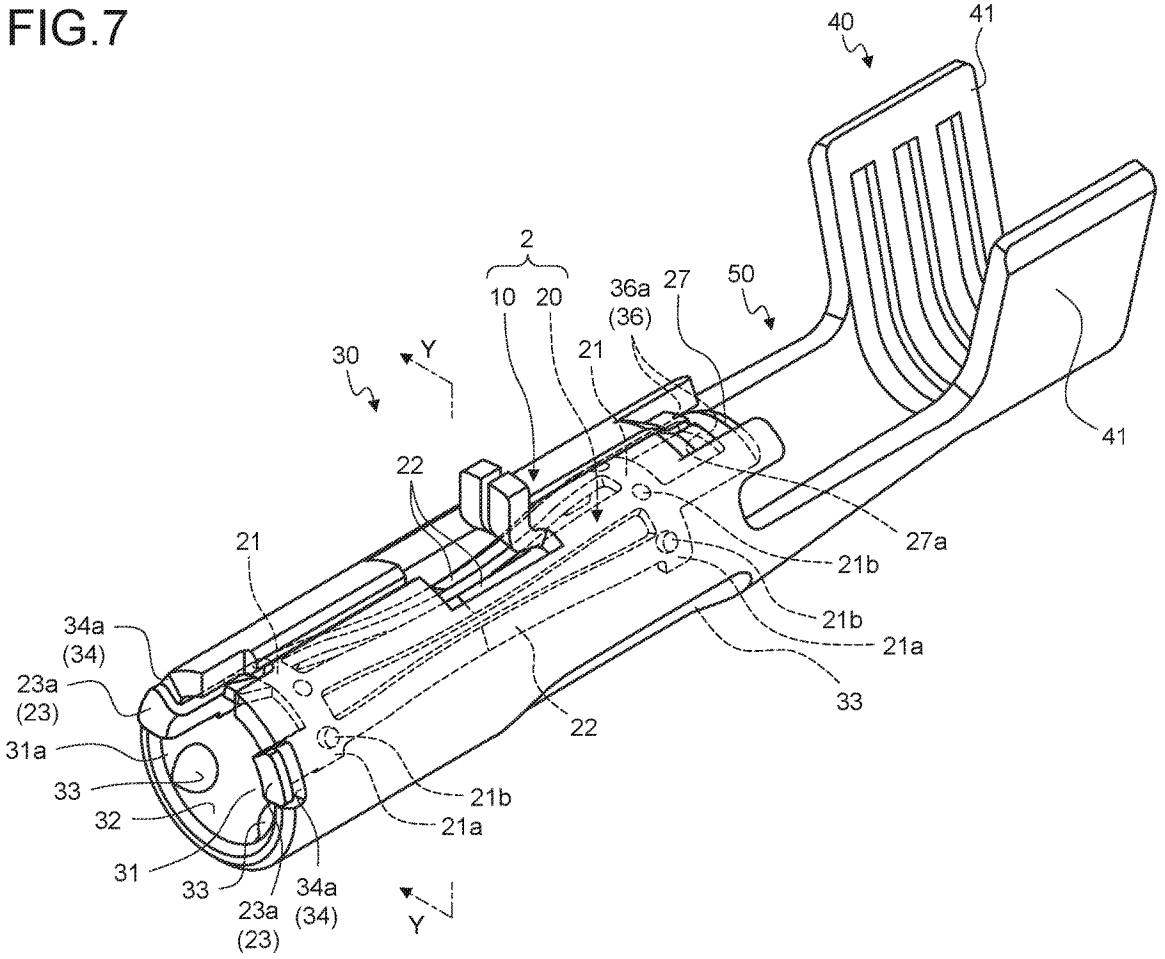
FIG. 7 is a perspective view of a connection terminal of a modification.
Figure 9:
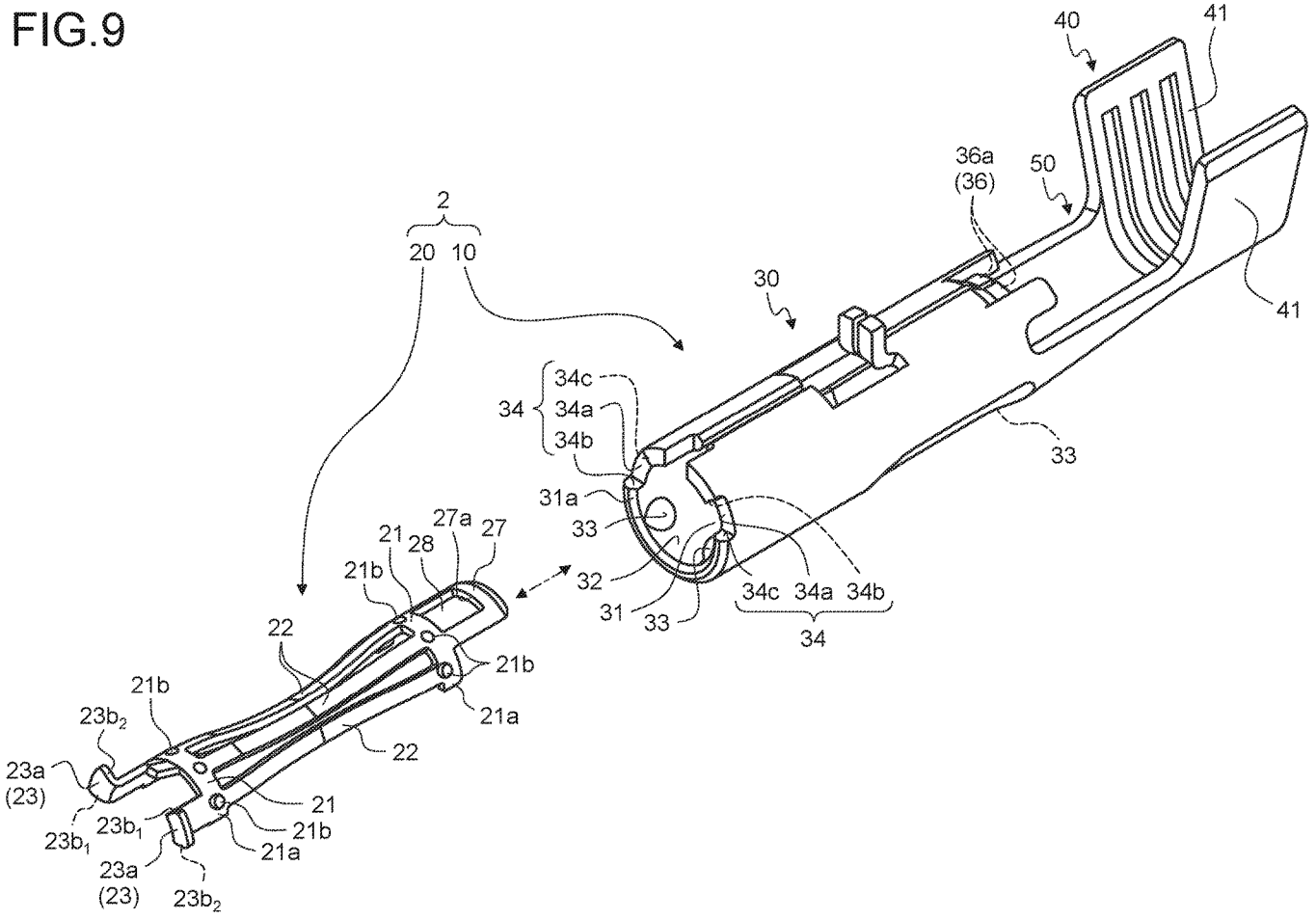
FIG. 9 is an exploded perspective view of the connection terminal of the modification.

The insertion direction locking structure of the present modification is provided for the same purpose as that of the connection terminal 1 of the embodiment. This insertion direction locking structure includes the first locked parts 23*a* provided on the contact member 20 and the first locking parts 34*a* provided on the female connector 30 to lock the movement of the first locked parts 23*a* in the male terminal insertion direction (FIG. 7 and FIG. 9). The insertion direction locking structure of the present modification is provided on the opening 31*a* side similarly to the connection terminal 1 of the embodiment.

Each of the first locked parts 23*a* of the present modification is the corresponding locking body 23 itself, having a substantially rectangular piece shape, and is provided on the first contact 21 on the opening 31*a* side. The locking bodies 23 protrude outward in the radial direction from the end on the opening 31*a* side of the first contact 21 so as to protrude toward the inner circumferential face 32 of the female connector 30 from the contact member 20 after the completion of being accommodated.

The first locking parts 34*a* of the present modification are provided in the notches 34 at the end on the opening 31*a* side of the female connector 30 similarly to the connection terminal 1 of the embodiment. The notches 34 are shaped and arranged so as to cause the first locked parts 23*a* (the locking bodies 23) to be inserted concurrently with the completion of accommodation of the contact member 20 into the internal space 31 and has a wall thereof in the male terminal insertion direction in the male terminal insertion/removal direction. The wall is provided on the side thereof in the male terminal insertion direction beyond the first locked part 23*a* of the contact member 20 after the completion of being accommodated and faces the end or the wall face of this first locked part 23*a* in the male terminal insertion direction. Consequently, in these notches 34, the wall is used as the first locking parts 34*a*.

In the insertion direction locking structure of the present modification, one first locked part 23*a* and one first locking part 34*a* form a combination, and two combinations thereof are provided to be spaced apart from each other in the circumferential direction similarly to the connection terminal 1 of the embodiment. Consequently, in this insertion direction locking structure, one first locking part 34*a* is arranged at each end in the circumferential direction of the first contact 21 on the opening 31*a* side, and one notch 34 corresponding to the position of each of the first locking parts 34*a* is formed at each end on the opening 31*a* side of the female connector 30.

This insertion direction locking structure can inhibit the positional deviation of the contact member 20 within the internal space 31 in the axial line direction (the male terminal insertion direction) relative to the female connector 30 under various situations similarly to that of the connection terminal 1 of the embodiment.

The connection terminal 2 of the present modification provides the circumferential locking structure that uses the components (the locking body 23 and the notch 34) of this insertion direction locking structure similarly to the connection terminal 1 of the embodiment.

Figure 8:
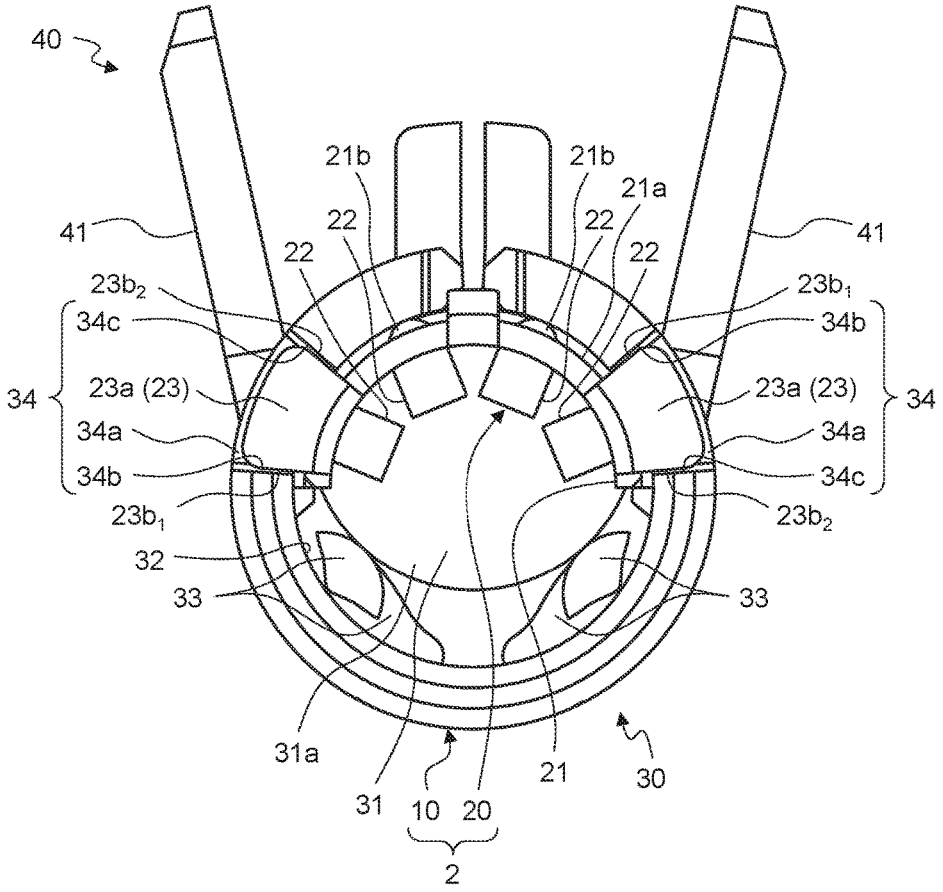
FIG. 8 is an elevational view of the connection terminal of the modification.

The circumferential locking structure of the present modification uses ends $\mathbf{23}b_1$ and $\mathbf{23}b_2$ in the circumferential direction of the locking bodies 23 as the first and the second circumferential locked parts $\mathbf{23}b_1$ and $\mathbf{23}b_2$, respectively (FIG. 8 and FIG. 9). In the notches 34, ends 34*b* and 34*c* in the circumferential direction thereof are used as the first and second circumferential locking parts 34*b* and 34*c*, respectively (FIG. 8 and FIG. 9). The first circumferential locked parts $\mathbf{23}b_1$ and the first circumferential locking parts 34*b* are arranged opposite each other in the circumferential direction similarly to those of the connection terminal 1 of the embodiment. The second circumferential locked parts $\mathbf{23}b_2$ and the second circumferential locking parts 34*c* are arranged opposite each other in the circumferential direction similarly to those of the connection terminal 1 of the embodiment.

This circumferential locking structure can inhibit the positional deviation of the contact member 20 within the internal space 31 in the circumferential direction relative to the female connector 30 under various situations similarly to that of the connection terminal 1 of the embodiment.

Figure 10:
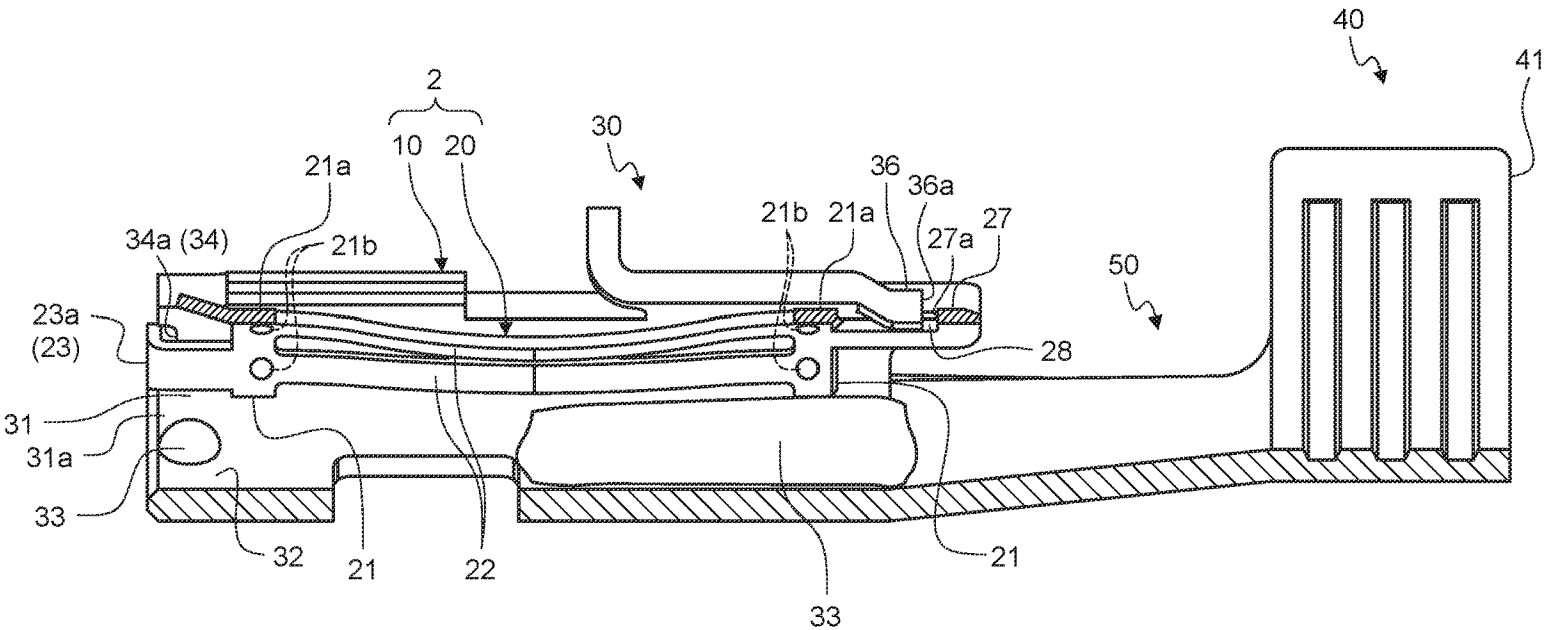
FIG. 10 is a Y-Y line sectional view of FIG. 7.

The removal direction locking structure of the present modification is provided for the same purpose as that of the connection terminal 1 of the embodiment. This removal direction locking structure includes a second locked part 27*a* provided on the contact member 20 and a second locking part 36*a* provided on the female connector 30 to lock the movement of the second locked part 27*a* in the male terminal removal direction (FIG. 7, FIG. 9, and FIG. 10). The removal direction locking structure of the present modification is provided at the end on the coupler 50 side of the contact member 20. The contact member 20 of the present modification provides an accommodation space 28 such as a groove, a through hole, or a notch into which an object to be accommodated is accommodated at the end on the coupler 50 side (the side in the end on the male terminal insertion direction). In the accommodation spaces 28, walls of the contact member 20 in the male terminal insertion direction are used as the second locked parts 27*a*. The female connector 30 of the present modification provides protruding parts 36 protruding inward (in other words, toward the internal space 31) at the end on the coupler 50 side (FIG. 10). The protruding parts 36 are formed so as to be inserted into the accommodation spaces 28 of the contact member 20 concurrently with the completion of accommodation of the contact member 20 into the internal space 31, and walls thereof in the male terminal insertion direction are used as the second locking parts 36*a*.

This exemplary contact member 20 includes an arcuate part 27 at the end thereof in the male terminal insertion direction (FIG. 9). This arcuate part 27 is formed to be along a part in the circumferential direction of the inner circumferential face 32 of the female connector 30 and is arranged to be spaced apart from the first contact 21 on the coupler 50 in the male terminal insertion direction. In the contact member 20, a through hole is formed between the first contact 21 on the coupler 50 side and the arcuate part 27 by the gap. In the contact member 20 of the present modification, the through hole is used as the accommodation space 28, and a wall of this through hole in the male terminal insertion direction (in other words, a wall of the arcuate part 27 in the male terminal removal direction) is used as the second locked part 27*a*.

The exemplary female connector 30 includes the protruding parts 36 inclined inward (toward the internal space 31) (FIG. 10). The exemplary protruding parts 36 are extended obliquely in the male terminal insertion direction and extended toward the internal space 31. These protruding parts 36 have flexibility with the base in the male terminal removal direction as a support so as to enable free ends thereof in the male terminal insertion direction to move in the radial direction. In this female connector 30, owing to its flexibility, at least the free end side of the protruding parts 36 is inserted into the accommodation space 28. In the female connector 30 of the present modification, walls of the protruding parts 36 in the free end side (in the male terminal insertion direction) are used as the second locking parts 36*a*.

The arcuate part 27 and the protruding parts 36 set their mutual positional relation so as to cause the protruding parts 36 to be pushed outward in the radial direction by the arcuate part 27 when the contact member 20 is inserted into the internal space 31. Further, the arcuate part 27 and the protruding parts 36 set their mutual positional relation so as to cause the pushed protruding parts 36 to be inserted into the accommodation spaces 28 of the contact member 20 to return to an original position after the completion of accommodation of the contact member 20 into the internal space 31. For this purpose, the second locking parts 36*a* of the protruding parts 36 are provided at a side thereof in the male terminal removal direction beyond the second locked parts 27*a* of the contact member 20 after the completion of being accommodated, and face wall faces of these second locked parts 27*a* in the male terminal removal direction. Still further, the arcuate part 27 and the protruding parts 36 set their mutual positional relation so as to cause the second locked parts 27*a* and the second locking parts 36*a* to have a predetermined gap therebetween when the contact member 20 has been completely accommodated into the internal space 31. The predetermined gap may be set to be similar to the gap between the second locked parts 24 and the second locking part 35*a* of the embodiment.

In the thus configured removal direction locking structure of the present modification, even if a force in the male terminal removal direction acts on the contact member 20, and the contact member 20 attempts to relatively move relative to the female connector 30 in the direction, the second locked parts 27*a* are locked by the second locking parts 36*a*. Consequently, this removal direction locking structure can inhibit the positional deviation of the contact member 20 within the internal space 31 in the axial line direction (the male terminal removal direction) relative to the female connector 30 under various situations similarly to the connection terminal 1 of the embodiment.

As described above, the connection terminal 2 of the present modification can inhibit the positional deviation of the contact member 20 relative to the female connector 30 similarly to the connection terminal 1 of the embodiment, and an effect equivalent to that of the connection terminal 1 can be obtained.

Figure 11:
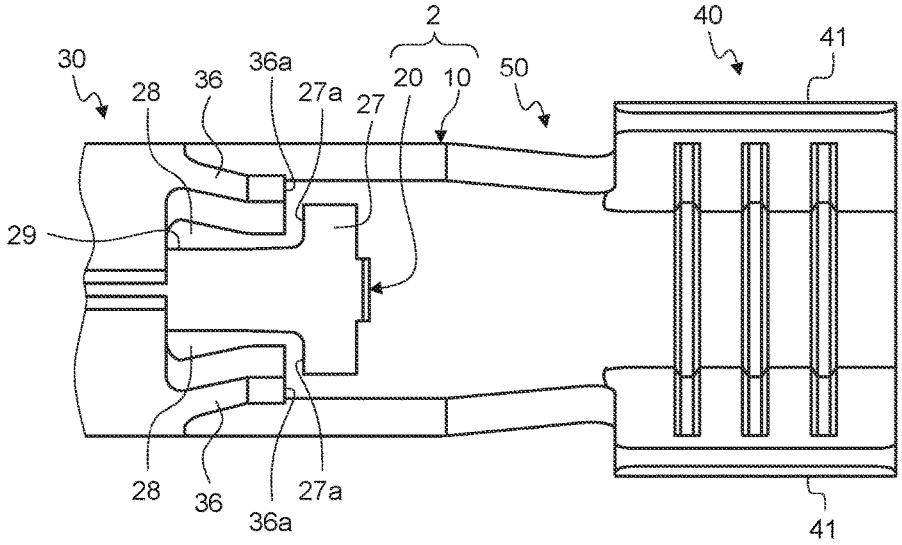
FIG. 11 is a top view of a locking structure of a different pattern.

In this connection terminal 2, the removal direction locking structure may be replaced with one illustrated in FIG. 11.

Figure 12:
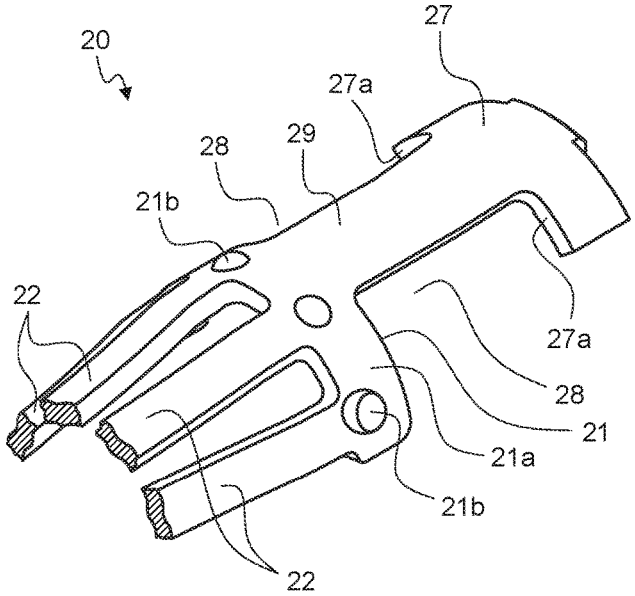
FIG. 12 is a perspective view of the contact member of the locking structure of the different pattern.

In this removal direction locking structure, the accommodation spaces 28 provided at the end on the coupler 50 side of the contact member 20 (the end in the male terminal insertion direction) are formed as notches, and walls of the notches in the male terminal insertion direction are used as the second locked parts 27*a*. This contact member 20 has the arcuate part 27 arranged to be spaced apart from the first contact 21 on the coupler 50 in the male terminal insertion direction, for example, and the first contact 21 and the arcuate part 27 are coupled to each other by a coupling part 29 (FIG. 12). The coupling part 29 couples the respective central parts in the circumferential direction of the first contact 21 and the arcuate part 27 to each other. Consequently, two notches are formed between the first contact 21 and the arcuate part 27. In this contact member 20, two walls of the respective notches in the male terminal insertion direction (accommodation spaces 28) and in the male terminal removal direction of the arcuate part 27 are used as second locked parts 27*a*.

At the end on the coupler 50 side of the female connector 30, protruding parts 36 similar to the example described above are provided corresponding to the positions of the respective accommodation spaces 28. The protruding parts 36 are formed so as to be inserted into the accommodation spaces 28 of the contact member 20 concurrently with the completion of accommodation of the contact member 20 into the internal space 31, and walls thereof in the male terminal insertion direction are used as second locking parts 36*a*.

Even when thus configured, the removal direction locking structure can inhibit the positional deviation of the contact member 20 within the internal space 31 in the axial line direction (the male terminal removal direction) relative to the female connector 30 under various situations.

The connection terminal according to the present embodiment can inhibit the positional deviation of the contact member within the internal space in the male terminal insertion direction relative to the female connector by the first locked part of the contact member and the first locking part of the female connector and can inhibit the positional deviation of the contact member within the internal space in the male terminal removal direction relative to the female terminal by the second locked part of the contact member and the second locking part of the female connector. In other words, this connection terminal can inhibit the positional deviation of the contact member within the internal space in the axial line direction (the male terminal insertion/removal direction) relative to the female connector by this simple configuration without newly providing any exclusive components.

Although the invention has been described with respect to the specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal comprising:

a terminal main body that is made of a conductive material and has a female connector provided with a columnar internal space into which a male connector of a counter male terminal is inserted and a wire connector to which a conducting part of a wire is electrically connected; and a contact member that is made of a conductive material, is accommodated into the internal space along a part in a circumferential direction of an inner circumferential face of the female connector and is electrically connected to the female connector, and is electrically connected to the male connector inserted into the internal space from an opening serving as a male terminal insertion port of the female connector, wherein the contact member is formed along the part in the circumferential direction of the inner circumferential face of the female connector and includes at least one first locked part and at least one second locked part adjacent to each other and being extended at an edge of the contact member, and the female connector includes a first locking part that is arranged at an edge thereof and on a side of the female connector in an insertion direction of the male connector into the internal space relative and adjacent to the first locked part of the contact member after completion of being accommodated into the internal space and that locks movement of the first locked part to the side in the insertion direction in order to maintain an accommodated state of the contact member in the internal space, and a second locking part that is arranged at an edge and on a side of the female connector in a removal direction of the male connector opposite to the insertion direction relative and adjacent to the second locked part of the contact member after the completion of being accommodated and that locks movement of the second locked part to the side in the removal direction in order to maintain the accommodated state of the contact member in the internal space.

2. The connection terminal according to claim 1, wherein the first locked part protrudes toward the inner circumferential face of the female connector from the contact member after the completion of being accommodated, and the female connector has a notch into which the first locked part is inserted upon the completion of accommodation of the contact member into the internal space at an end in a side of the opening, and a wall of the notch in the insertion direction is used as the first locking part.

3. The connection terminal according to claim 1, wherein the second locked part protrudes toward the inner circumferential face of the female connector from the contact member after the completion of being accommodated, and the female connector has an accommodation space into which the second locked part is accommodated upon the completion of accommodation of the contact member into the internal space, and a wall of the accommodation space in the removal direction is used as the second locking part.

4. The connection terminal according to claim 2, wherein the second locked part protrudes toward the inner circumferential face of the female connector from the contact member after the completion of being accommodated, and the female connector has an accommodation space into which the second locked part is accommodated upon the completion of accommodation of the contact member into the internal space, and a wall of the accommodation space in the removal direction is used as the second locking part.

5. The connection terminal according to claim 1, wherein the contact member has an accommodation space into which an object to be accommodated is accommodated, and a wall of the accommodation space in the insertion direction is used as the second locked part, and the female connector has a protruding part that protrudes toward the internal space and is accommodated into the accommodation space upon the completion of accommodation of the contact member into the internal space, and a wall of the protruding part in the insertion direction is used as the second locking part.

6. The connection terminal according to claim 2, wherein the contact member has an accommodation space into which an object to be accommodated is accommodated, and a wall of the accommodation space in the insertion direction is used as the second locked part, and the female connector has a protruding part that protrudes toward the internal space and is accommodated into the accommodation space upon the completion of accommodation of the contact member into the internal space, and a wall of the protruding part in the insertion direction is used as the second locking part.

7. The connection terminal according to claim 1, wherein the contact member includes at least two first contacts arranged to be spaced apart from each other in an insertion/removal direction of the female connector and a plurality of second contacts serving as coupling parts that couple the two adjacent first contacts to each other, the first contacts are formed along the part in the circumferential direction of the inner circumferential face of the female connector and are electrically connected to the inner circumferential face on an opposite face side to the inner circumferential face, and the second contacts are arranged in the internal space while being coupled to the first contacts, are push-moved toward the inner circumferential face of the female connector by the male connecter inserted into the internal space and are electrically connected to the male connector, and are formed in an arcuate shape protruding inward in a radial direction of the internal space between the two adjacent first contacts so as to be bent outward in the radial direction when being pushed outward in the radial direction of the internal space by the male connector inserted into the internal space.

8. The connection terminal according to claim 2, wherein the contact member includes at least two first contacts arranged to be spaced apart from each other in an insertion/removal direction of the female connector and a plurality of second contacts serving as coupling parts that couple the two adjacent first contacts to each other, the first contacts are formed along the part in the circumferential direction of the inner circumferential face of the female connector and are electrically connected to the inner circumferential face on an opposite face side to the inner circumferential face, and the second contacts are arranged in the internal space while being coupled to the first contacts, are push-moved toward the inner circumferential face of the female connector by the male connecter inserted into the internal space and are electrically connected to the male connector, and are formed in an arcuate shape protruding inward in a radial direction of the internal space between the two adjacent first contacts so as to be bent outward in the radial direction when being pushed outward in the radial direction of the internal space by the male connector inserted into the internal space.

9. The connection terminal according to claim 3, wherein the contact member includes at least two first contacts arranged to be spaced apart from each other in an insertion/removal direction of the female connector and a plurality of second contacts serving as coupling parts that couple the two adjacent first contacts to each other, the first contacts are formed along the part in the circumferential direction of the inner circumferential face of the female connector and are electrically connected to the inner circumferential face on an opposite face side to the inner circumferential face, and the second contacts are arranged in the internal space while being coupled to the first contacts, are push-moved toward the inner circumferential face of the female connector by the male connecter inserted into the internal space and are electrically connected to the male connector, and are formed in an arcuate shape protruding inward in a radial direction of the internal space between the two adjacent first contacts so as to be bent outward in the radial direction when being pushed outward in the radial direction of the internal space by the male connector inserted into the internal space.

10. The connection terminal according to claim 5, wherein the contact member includes at least two first contacts arranged to be spaced apart from each other in an insertion/removal direction of the female connector and a plurality of second contacts serving as coupling parts that couple the two adjacent first contacts to each other, the first contacts are formed along the part in the circumferential direction of the inner circumferential face of the female connector and are electrically connected to the inner circumferential face on an opposite face side to the inner circumferential face, and the second contacts are arranged in the internal space while being coupled to the first contacts, are push-moved toward the inner circumferential face of the female connector by the male connecter inserted into the internal space and are electrically connected to the male connector, and are formed in an arcuate shape protruding inward in a radial direction of the internal space between the two adjacent first contacts so as to be bent outward in the radial direction when being pushed outward in the radial direction of the internal space by the male connector inserted into the internal space.

* * * * *